US007849775B2

(12) United States Patent
Yoder

(10) Patent No.: US 7,849,775 B2
(45) Date of Patent: Dec. 14, 2010

(54) SCRAPBOOKING TOOLS

(75) Inventor: Regina Yoder, Arthur, IL (US)

(73) Assignee: Craft-N-Doodle, LLC, Lexington, KY (US)

( * ) Notice: Subject to any disclaimer, the term of this patent is extended or adjusted under 35 U.S.C. 154(b) by 651 days.

(21) Appl. No.: 11/909,362

(22) PCT Filed: Mar. 30, 2006

(86) PCT No.: PCT/US2006/011885

§ 371 (c)(1),
(2), (4) Date: Sep. 21, 2007

(87) PCT Pub. No.: WO2006/105389

PCT Pub. Date: Oct. 5, 2006

(65) Prior Publication Data

US 2010/0139102 A1 Jun. 10, 2010

Related U.S. Application Data

(60) Provisional application No. 60/667,137, filed on Mar. 30, 2005.

(51) Int. Cl.
*B26D 1/18* (2006.01)
*B26B 9/00* (2006.01)
*B25H 3/00* (2006.01)

(52) U.S. Cl. ..... 83/485; 83/455; 83/469; 83/614; 83/678; 30/276

(58) Field of Classification Search ..... 83/469, 83/485, 614, 678, 455, 564, 588, 486.1, 481; 30/276; 81/487
See application file for complete search history.

(56) References Cited

U.S. PATENT DOCUMENTS

| | | | | | |
|---|---|---|---|---|---|
| 235,163 | A | * | 12/1880 | Marshall | 83/469 |
| 1,998,357 | A | * | 4/1935 | Carison | 83/864 |
| 5,322,001 | A | * | 6/1994 | Boda | 83/485 |
| 5,363,958 | A | * | 11/1994 | Horan | 206/356 |
| 5,537,904 | A | | 7/1996 | Albin | |
| 6,018,850 | A | | 2/2000 | Lorber | |
| 6,675,689 | B2 | | 1/2004 | Nunez et al. | |
| 6,923,099 | B2 | | 8/2005 | Rugg et al. | |
| 2006/0053994 | A1 | * | 3/2006 | Carrillo et al. | 83/485 |
| 2006/0117925 | A9 | * | 6/2006 | Volfson et al. | 83/485 |

OTHER PUBLICATIONS

PCT International Search Report relating to PCT/US06/11885 mailed on Oct. 30, 2007.
PCT Written Opinion of the International Searching Authority relating to PCT/US06/11885 mailed on Oct. 30, 2007.

* cited by examiner

*Primary Examiner*—Ghassem Alie
(74) *Attorney, Agent, or Firm*—IpHorgan Ltd.

(57) ABSTRACT

A tool body for use in scrapbooking includes a groove for accepting a plurality of interchangeable tools therein. The tool body may include two or more separate bodies that may be connected together. The interchangeable tools may include a rotary cutter having one or more offset patterned blades. The housings of the rotary cutter may be attached together to form patterned strips having three different widths. The rotary cutter may be used separately or include an adapter for traveling in the groove of the tool body.

15 Claims, 22 Drawing Sheets

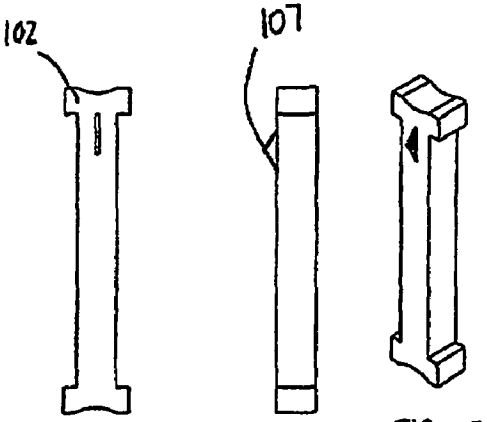
FIG. 10D
FIG. 10E
FIG. 10F
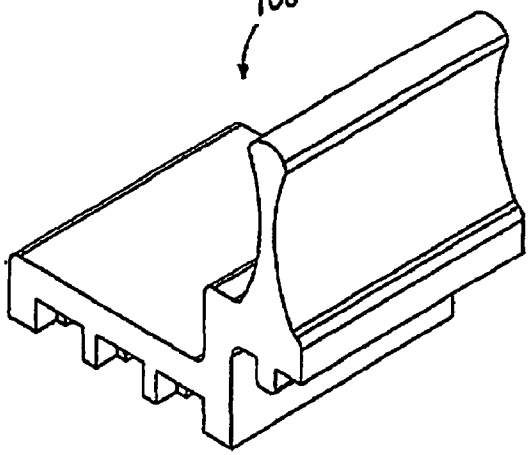
FIG. 10A
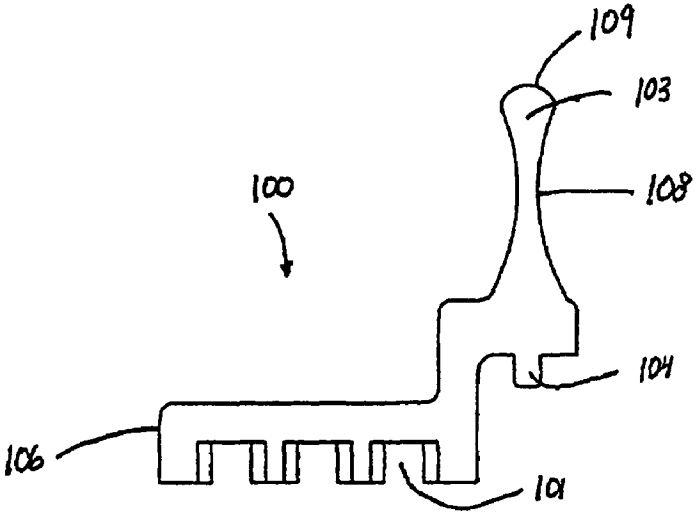
FIG. 10B
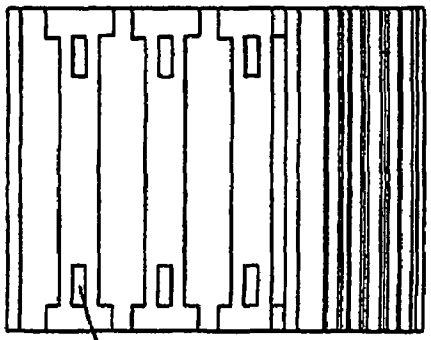
FIG. 10C

42

42

47

47

47

43

43

43

SCRAPBOOKING TOOLS

This application is a national phase patent application of PCT patent application Ser. No. PCT/US2006/011885, which claims priority based upon U.S. provisional patent application Ser. No. 60/667,137, filed Mar. 30, 2005.

TECHNICAL FIELD

The present invention relates to scrapbooking and in particular to, tools used in scrapbooking.

BACKGROUND ART

The making of memory albums, more commonly known as "scrapbooking" has become a growing hobby in the last several years. Part of preserving memories is cropping photos into different shapes and arranging them in an attractive way, then embellishing the page with an array of different mediums, such as background mats, strips of paper, stickers and stamps. Finally, thoughts and memos are added to the page. This writing is otherwise known as "journaling".

In the process of embellishing the page, the handling of very small stickers, such as the dot above an "i" is often required. This can often become a difficult task.

One of the most common shapes that photos are cropped into is a circle. Often colored paper, also cut into a circle, is used as a background mat for the photo. If a person wants to cut a circle out of a circle, or a donut shape, two separate cuts must be made at different intervals from the center of the circle.

When cropping photos or cutting paper into various shapes, many users desire a decorative cut rather than a straight edge. Many different blade patterns are available in scissors, which require that the user make a cut the length of the scissors, then attempt to line up the design exactly before proceeding with the next cut so that the design is not interrupted at any point. If a strip is desired, the same care must be taken to align the patterns so that they match the pattern parallel to them.

If a user wants to create a strip of paper with which to embellish the page, again, two cuts must be made, and extra care taken to make the two cuts parallel to each other.

Embossing is the process of creating a raised image on the front side of a medium, such as paper or foil, by applying pressure from the backside, inside the bounds of a stencil.

Stamping is another popular way to add images to a scrapbook page. The user applies ink to the face of a stamp image and applies the stamp to the paper, transferring the ink onto the paper. Each stamp is commonly mounted on a block of wood for handling, and the ink is usually supplied in many different colors, each color in its own separate package. Because each of the stamps and stamp pads are commonly sold separately, a collection of stamps and stamp pads takes up a lot of storage and makes it more cumbersome to transport.

When stamping, journaling or arranging stickers, a ruler is often used as a straight edge for aligning words, letters, or images in a straight line; however, it is often very difficult to properly align the material as, among other things, the paper and/or ruler may move during use.

Therefore, there is a need to produce scrapbooking tools that are user-friendly and address the problems with the prior tools and methods, while being economical and easy to manufacture.

DISCLOSURE OF THE INVENTION

The general objective of this invention is to facilitate several different tasks performed in the making of a scrapbook page.

In one embodiment, a plurality of interchangeable tools or attachments that perform different tasks may be used in connection with an elongated body of a main tool. The tool has an elongated shaft with a groove on its anterior side, which serves as a guide for various tools that travel in the groove. One end of the shaft may have a post, with the other end containing an opening that accepts a post from a second tool body, allowing two bodies to be attached to each other, end to end, thus doubling the length of the tool body. The front side of the tool may be flat and include a plurality of spaced apart lines (e.g., ruler markings) to, among other things, guide the user in the proper sticker or stamp alignment.

To help stabilize the main tool body, a set of small clips that extend distally from the body at each end and attach to the edge of the paper may be used. The clips secure the body to the paper, thus preventing movement or misalignment of the tool body during use.

One of the tools that may be used in connection with the tool body is a journaling guide. The journaling guide comprises a flat bottom portion with holes at measured intervals from the longitudinal axis of the body and into which a writing instrument is inserted. In operation, the tip of the writing instrument extends through the guide and comes in contact with the underlying paper or medium. The user then slides the guide left to right along the tool body to create a straight line. If multiple parallel lines are desired, the user may move the writing instrument to one or more different openings and repeat the process.

A straight cutter that permits one or more straight cuts to be made may also be used in connection with the tool. The straight cutter preferably comprises a plurality of openings on a base portion that accepts cutting members having a blade extending through one side of the cutting member. One or more blades can be exposed on the bottom side allowing the user to move the cutter along the tool body creating a single straight cut, or two or more cuts simultaneously, creating a strip. In a preferred embodiment, the straight cutter has three opening for accepting at least two cutting members, thereby allowing for two different sized strips to be made. In order to protect the blades and to prevent the blades from damaging materials or individuals, the bottom of the straight cutters may include recesses for receiving the blades in a stored position.

A rotary or wavy cutter may also be used in connection with the tool body or individually. The rotary cutter preferably includes a blade that is variegated to create patterns in the cut based on the pattern of the blade. The blade is preferably a circular blade that is contained within a housing by a shaft. If a strip is desired, a second blade and housing can be attached to the side of the first blade and two or more cuts made simultaneously. The two blades are keyed together by the shaft they turn on so that the two patterns are created exactly parallel to each other, and mirror each other. In a preferred embodiment, the blades are located offset from the center of their respective housings to permit three different widths of a strip to be cut. An adapter may be attached to one side of the rotary cutter to permit the cutter(s) to be operatively attached to the groove to facilitate the cutting process.

In order to cut a pair of concentric circles, a circle cutter having an upright shaft or post and one or more cutter arms with at least two cutting blades are used. A separate, smaller handle may attach to the upright shaft on which the cutter arm rotates. The blade can be placed at various distances from the center of the circle creating different circle sizes. With two arms extending from the post in opposite directions, two blades can be attached and arranged at different distances from the post, so that when the arms are rotated with the blades in contact with the underlying medium, two cuts are created simultaneously resulting in a donut shape object. This eliminates the task of cutting the medium twice.

An ergonomic hand tool or handle may also be used in connection with a plurality of interchangeable tools or with a particular tool. The handle includes a bulbous upper portion having an area for receiving the palm of a hand, a mid portion generally tapering from the upper portion having a smaller circumferential dimension than the upper portion for receiving the fingers of a user, and a third portion having a tool extending outwardly therefrom. The upper and mid portions are designed to allow a user to grasp the tool and comfortably hold it in a position so that the tool and working area remain in the line of sight of the user during use.

One tool that may be used in connection with the ergonomic hand tool or the elongated tool body is a sticker placer that is used to pick a small sticker off of the sticker sheet and place it on the page at the appropriate place without having difficulty seeing exactly where it is being placed. The sticker placer may include a flattened tip that can be inserted into either the main body, or the ergonomic hand tool. This tool also eliminates the need for fingers to come in contact with the sticker and thus it retains its maximum adhesiveness. This tip preferably includes sharp corners that can be used to remove stickers that have inadvertently been misaligned, or misplaced.

A stamp set comprising a handle (e.g., the ergonomic handle), a single stamp mount, and numerous stamps each affixed to a stamp backing may be used to allow a plurality of stamps to be used, while decreasing the amount of required storage space. Each stamp backing is designed to fit securely into the stamp mount. The mount is then inserted into or otherwise attached to the handle. This setup saves space and cost, as each stamp uses the same mount, rather than each stamp having its own separate mount. In order to facilitate use of the stamps, a stamp pad having a plurality of different colors all mounted on the same holder may be used, thus saving space and allowing all the colors to be available to the user at the same time.

An embosser tip may also be used with the ergonomic hand tool. In one embodiment, each end of the embosser tip is a different size (i.e., has a different sized contact area) and can be inserted into the handle with either end exposed. These tips are used to apply pressure to the back side of a medium inside the parameters of the stencil being used, thus creating a raised image on the front side.

A box designed to contain all the tools may be used to facilitate storage and traveling. In particular, the box enables the user to keep all the components organized in such a way that it is compact, convenient and each piece is easily accessible at all times.

BRIEF DESCRIPTION OF THE DRAWINGS

FIG. 10A is a perspective view of a cropper cutter of the invention.

FIG. 10B is a side elevation view of the cropper cutter of FIG. 10A.

FIG. 10C is a bottom plan view of the cropper cutter of FIG. 10A showing a plurality of recesses for storing the blades when not in use.

FIG. 10D is a bottom plan view of a blade for use in the cropper cutter of FIG. 10A.

FIG. 10E is a side elevation view of the blade of FIG. 10D.

FIG. 10F is a perspective view of the blade of FIG. 10D.

DETAILED DESCRIPTION OF THE INVENTION

Figure 1:
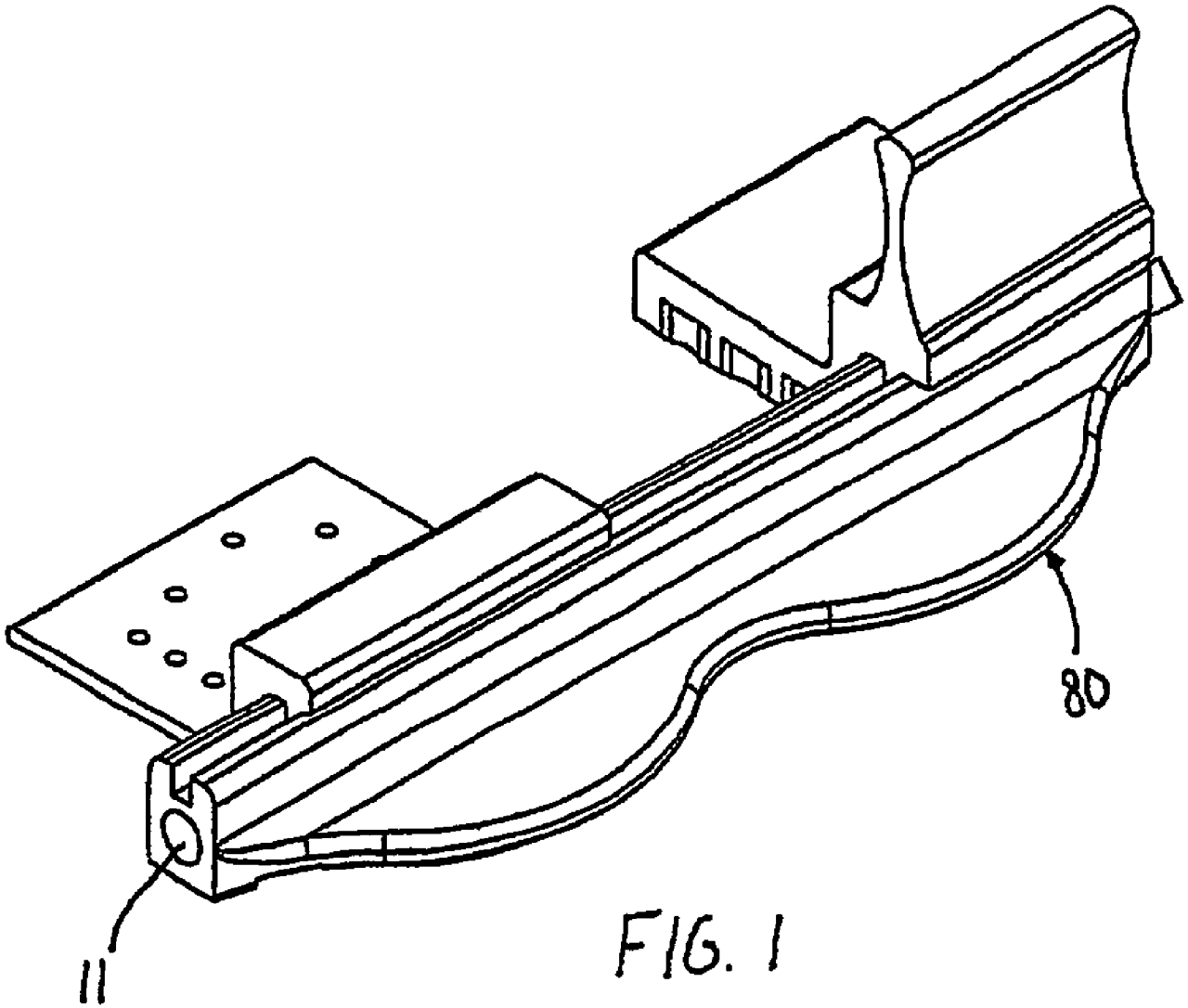
FIG. 1 is an isometric view of a tool body assembly with a line guide and a cropper\strip cutter of the present invention.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Referring to FIGS. 8A through 8G, an elongated tool, generally designated by the numeral 80, is shown for use with a plurality of tools for scrapbooking. The elongated body of the tool is designed for working on substantially flat surfaces. The tool has at least top, front, bottom, rear, left and right sides.

The underside of the tool body includes a pair of rectangular groves 85 that accept into them the raised edge of most scrapbook paper. While it is appreciated that the tool body may only include one groove, two grooves is preferred to permit the tool be used in a first direction or rotated 180 degrees and used in a second direction for any papers that only have one raised edge or ridges. Many brands of paper have a ridge 1/32" thick and 1/4" wide that covers the left and right edges of the paper from top to bottom. The grooves take advantage of the ridges along the edges of the paper to diminish movement of the tool and provide greater stability for the tool during its use.

Figure 2:
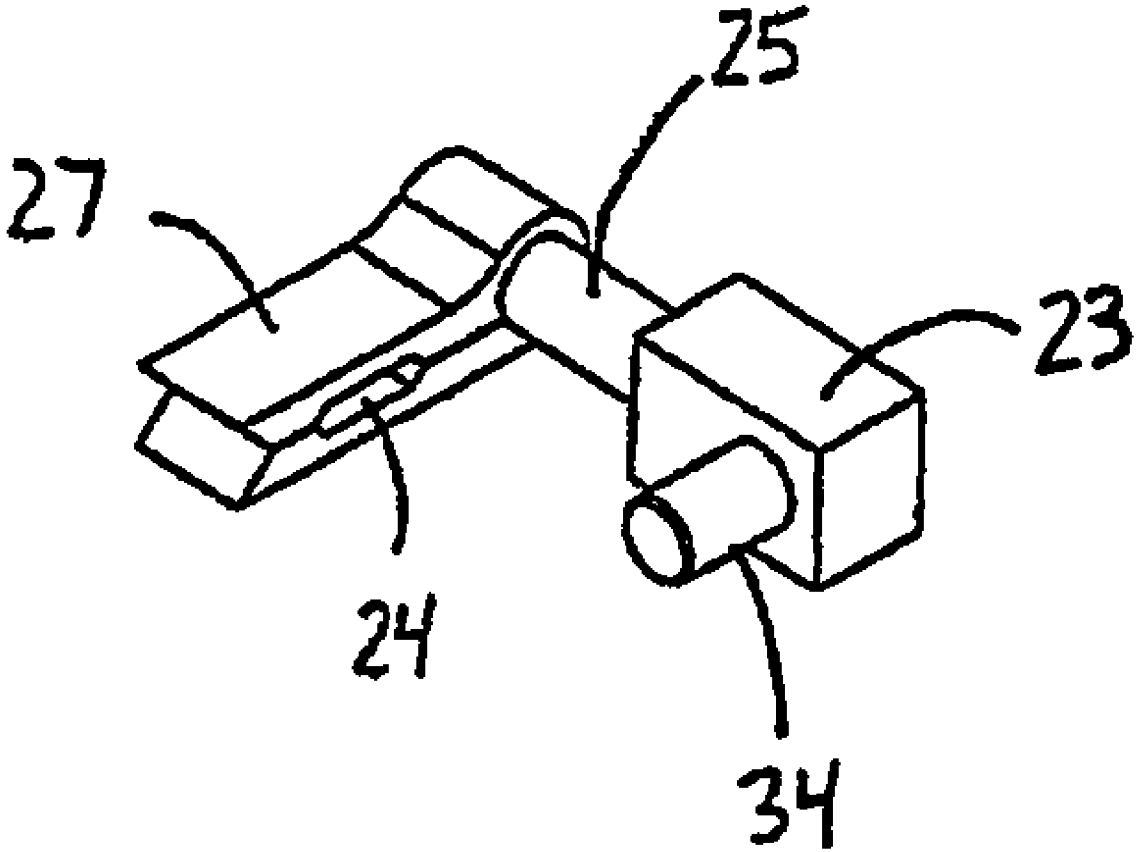
FIG. 2 is an isometric view of a clip assembly of the present invention.

One distal end 11 of the body 80 contains at least one tubular opening that may accept into it, among other things, clip attachments as shown in FIG. 2 or a second identical body. This tubular opening at the end of the body extends into the tool to the extent needed to securely hold the attachment introduced therein.

The opposite end of the tool body 80 has a post 83 protruding distally that a second tool body can accept, allowing two or more tool bodies to be securely connected, thus increasing the length of the tool body and thus increasing the length of the groove used as a guide. This allows for a longer length of paper to be accommodated by the tool. It is appreciated that the post also may accept a clip having a corresponding female member and not depart from the scope of the present invention.

One or more indentations 91 are preferably located on the bottom side of the tool 80 to accommodate non-slide (e.g., rubber) pads (not shown), which in turn provide friction, and thus stability, when pressure is applied to the top side of the tool. In a preferred embodiment, the tool includes at least two indentations, with one indentation located proximate the center of each half of the tool.

Figure 8B:
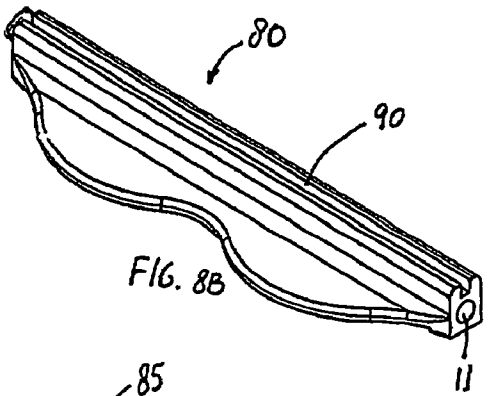
FIG. 8B is a perspective view of the tool body of the invention showing a groove.
Figure 8A:
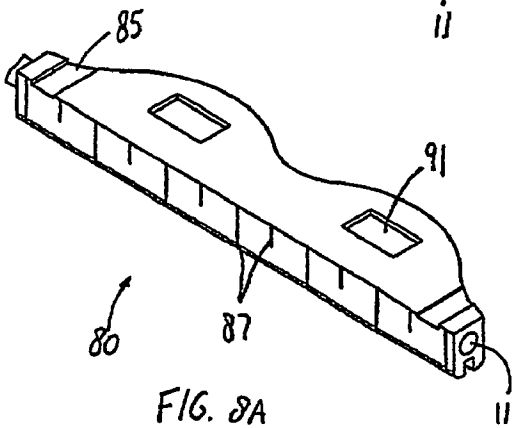
FIG. 8A is a perspective view of a tool body of the invention showing a pair of recesses for receiving non-slip pads.
Figure 8G:
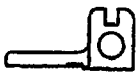
FIG. 8G is a side elevation view of tool body of FIG. 8A.
Figure 8C:
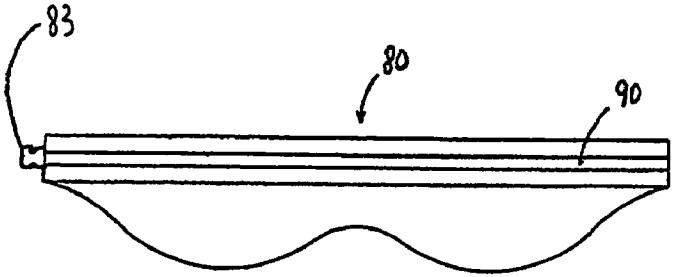
FIG. 8C is a top plan view of the tool body of FIG. 8A.
Figure 8D:
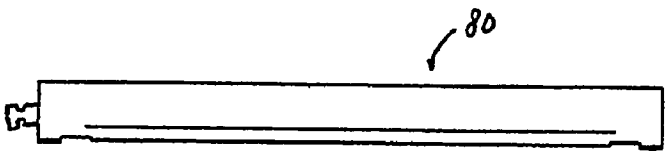
FIG. 8D is a rear elevation view of the tool body of FIG. 8A.
Figure 8E:
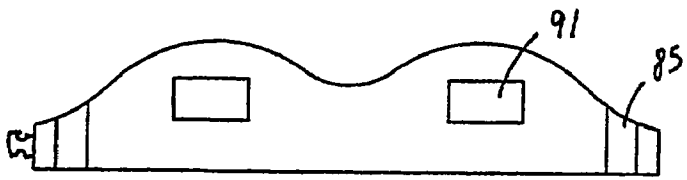
FIG. 8E is a bottom plan view of the tool body of FIG. 8A.
Figure 8F:
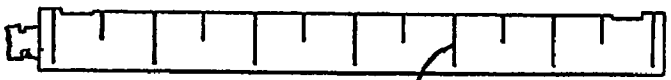
FIG. 8F is a front elevation view of the tool body of FIG. 8A.
Figure 9A:
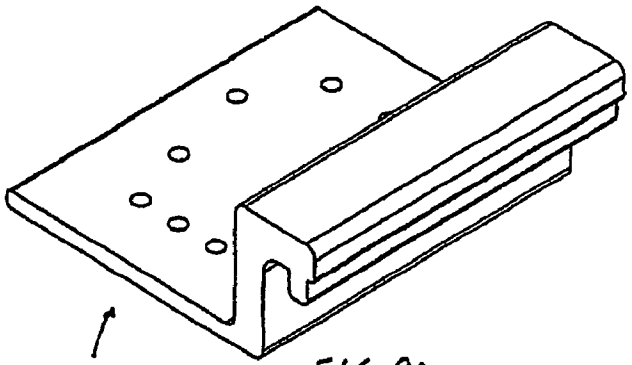
FIG. 9A is a perspective view of a line guide of the invention.
Figure 9D:
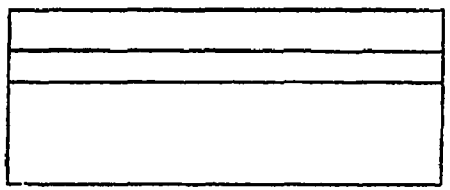
FIG. 9D is a rear elevation view of the line guide of FIG. 9A.
Figure 9B:
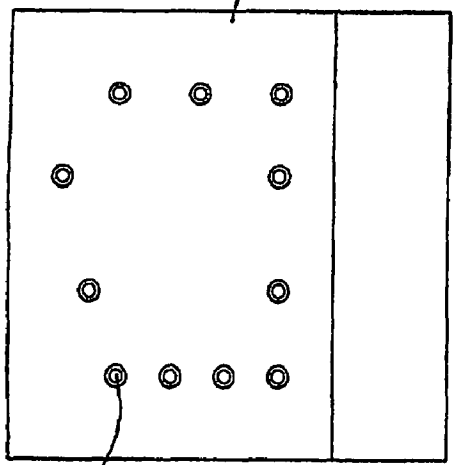
FIG. 9B is a top plan view of the line guide of FIG. 9A.
Figure 9C:
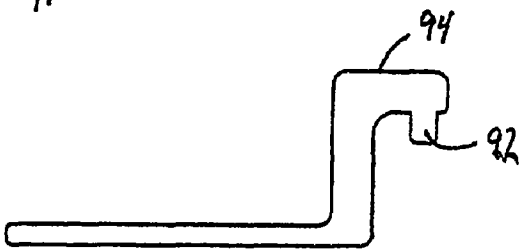
FIG. 9C is a side elevation view of the line guide of FIG. 9A.
Figure 11G:
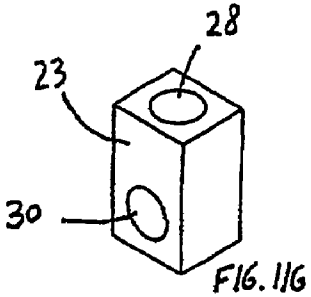
FIG. 11G is a perspective view of a connector of the present invention.
Figure 11J:
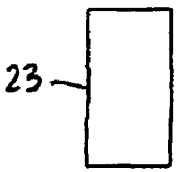
FIG. 11J is a side elevation view of the connector of FIG. 11G.
Figure 11M:
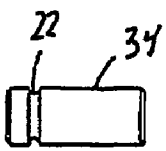
FIG. 11M is a side elevation view of the O-ring shaft of FIG. 11K.
Figure 11H:
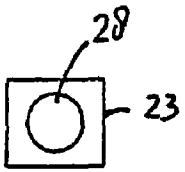
FIG. 11H is a top plan view of the connector of FIG. 11G.
Figure 11I:
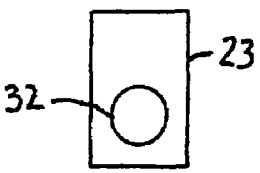
FIG. 11I is a front elevation view of the connector of FIG. 11G.
Figure 11L:
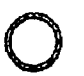
FIG. 11L is a top plan view of the O-ring shaft of FIG. 11K.
Figure 11K:
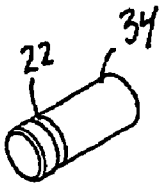
FIG. 11K is a perspective view of an O-ring shaft of the present invention.
Figure 11D:
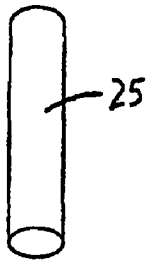
FIG. 11D is a perspective view of a flexible shaft of the present invention.
Figure 11E:
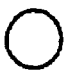
FIG. 11E is a side elevation view of the flexible shaft of FIG. 11D.
Figure 11F:
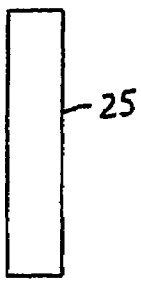
FIG. 11F is a top plan view of the flexible shaft of FIG. 11D.
Figure 11A:
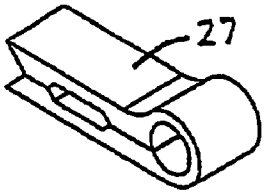
FIG. 11A is a perspective view of a clip head of the present invention.
Figure 11B:
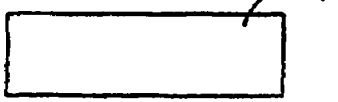
FIG. 11B is a bottom plan view of the clip head of FIG. 11A.
Figure 11C:
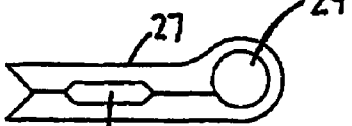
FIG. 11C is a side elevation view of the clip head of FIG. 11A.
Figures 12A, 12B, 12C, 12D, 12E, 12F, 12G, 12H, 12I, 12J:
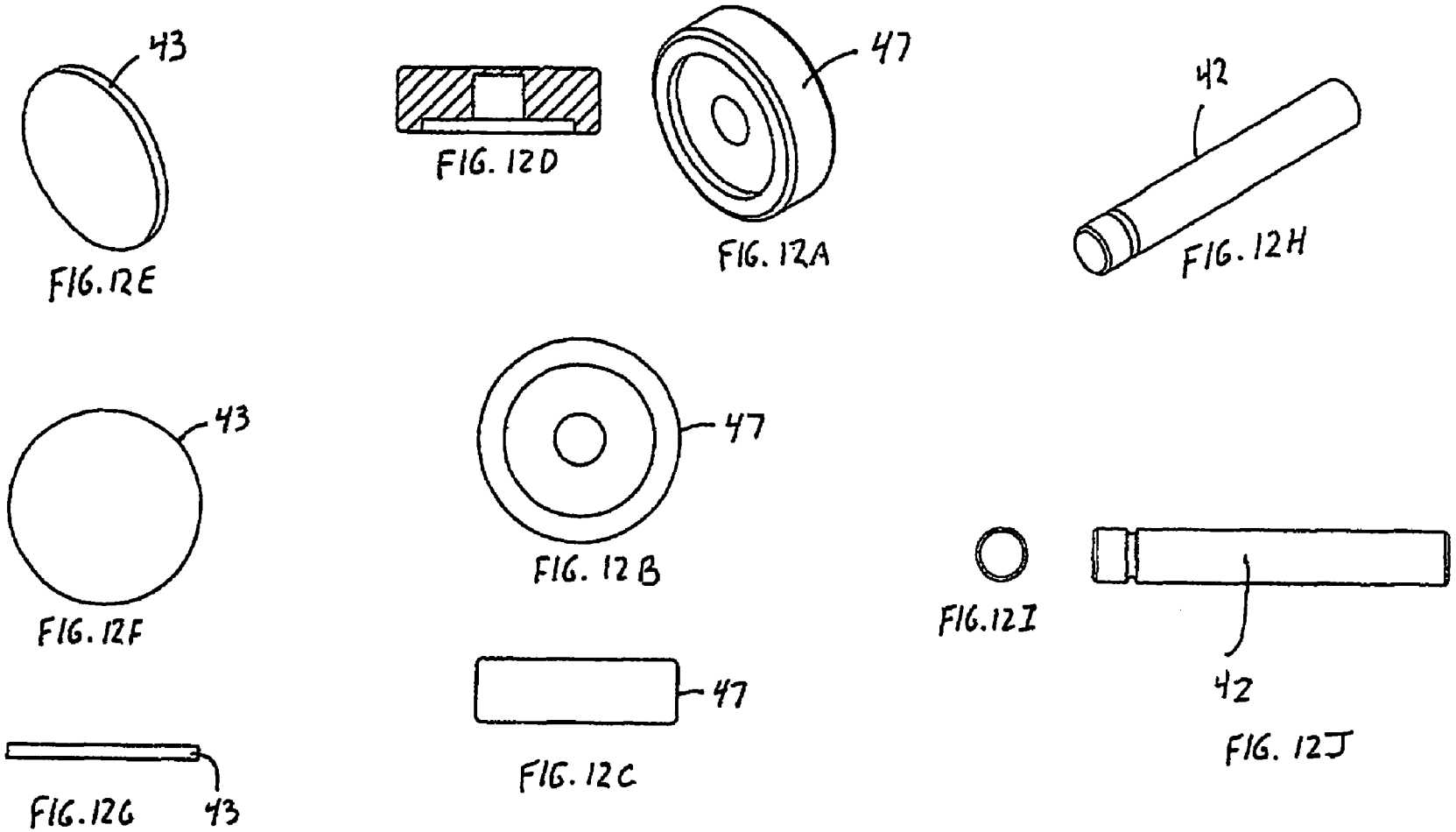
FIG. 12A is a perspective view of a circle cutter base of the present invention.
FIG. 12B is a top plan view of the circle cutter base of FIG. 12A.
FIG. 12C is a side elevation view of the circle cutter base of FIG. 12A.
FIG. 12D is a cross-sectional view of the circle cutter base of FIG. 12A.
FIG. 12E is a perspective view of a circle cutter base pad of the present invention.
FIG. 12F is a top plan view of the circle cutter base pad of FIG. 12E.
FIG. 12G is a side elevation of the circle cutter base pad of FIG. 12E.
FIG. 12H is a perspective view of a circle cutter shaft of the present invention.
FIG. 12I is a top plan view of the circle cutter shaft of FIG. 12H.
FIG. 12J is a side elevation view of the circle cutter shaft of FIG. 12H.

The main tool body accommodates markings 87 on the side of the tool. These markings are used for design layout, including correct spacing of letters, stickers or any other medium in which the user desires accurate spacing. As shown in FIGS. 8A and 8F, the markings may comprise a plurality of evenly-spaced apart vertical lines.

It is appreciated that additional extensions can be connected to the main body of the tool using the distal protrusion on one side of the main body of the tool or using the tubular opening on the opposing side of the main body of the tool.

Figure 3:
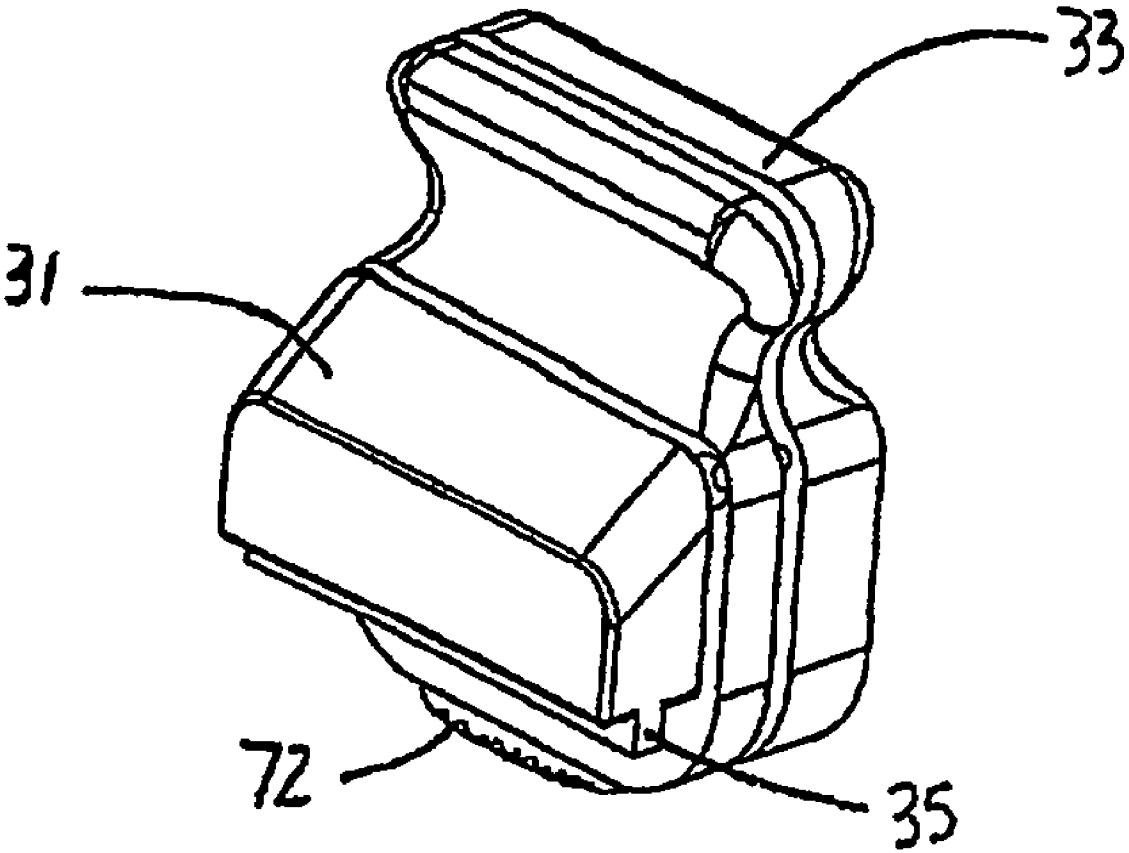
FIG. 3 is an isometric view of a rotary cutter assembly with guide attachment.
Figure 4:
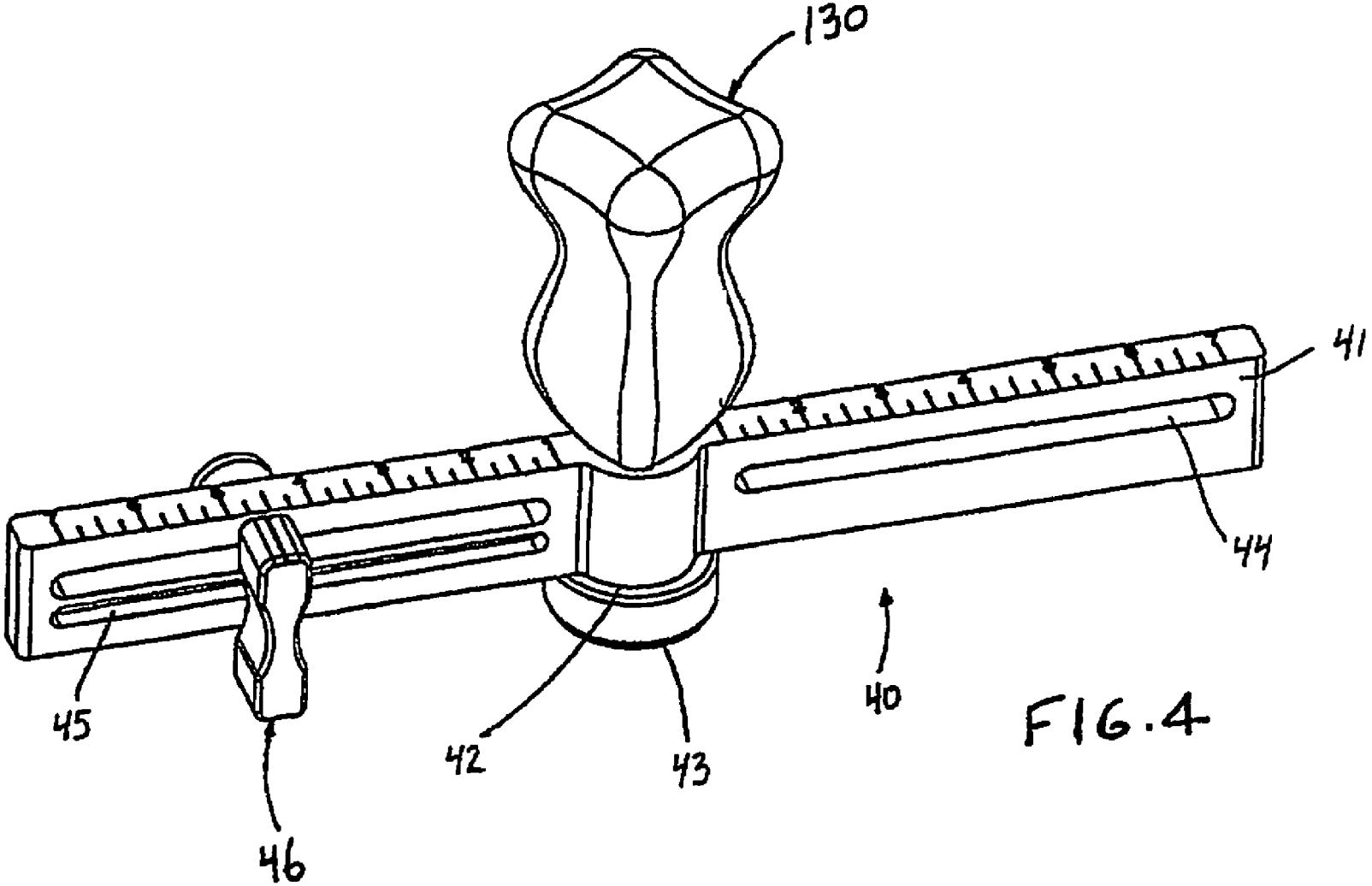
FIG. 4 is an isometric view of a circle cutter assembly of the present invention.
Figure 5B:
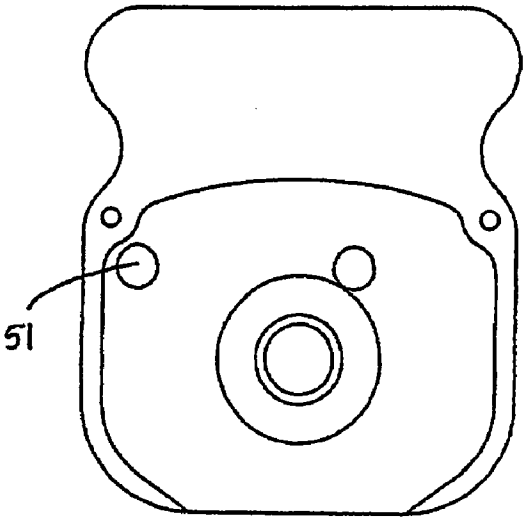
FIG. 5B is a rear elevation view of the housing of the rotary cutter of FIG. 5A.
Figure 5D:
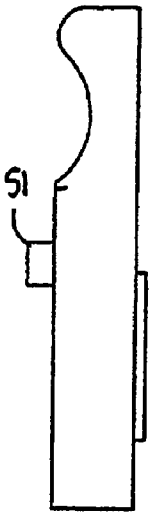
FIG. 5D is a side elevation view of the housing of FIG. 5A.
Figure 5A:
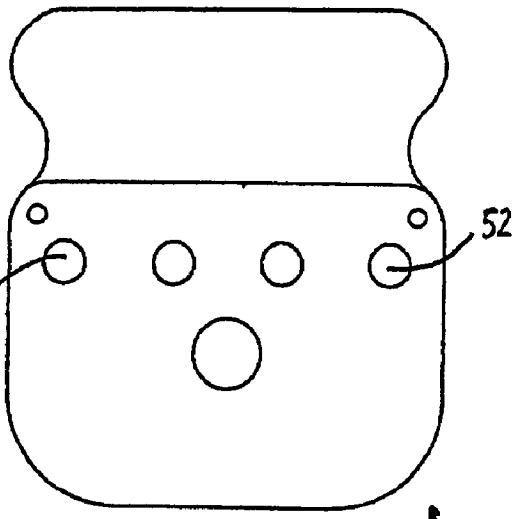
FIG. 5A is a front elevation view of the housing of a rotary cutter of the invention.
Figure 5F:
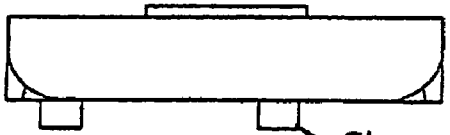
FIG. 5F is a top plan view of the housing of FIG. 5A.
Figure 5E:
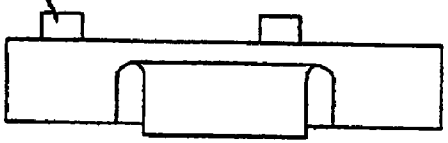
FIG. 5E is a bottom plan view of the housing of FIG. 5A.
Figure 5C:
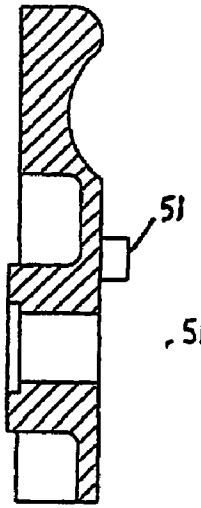
FIG. 5C is a cross-sectional view of the housing of FIG. 5A.
Figure 6B:
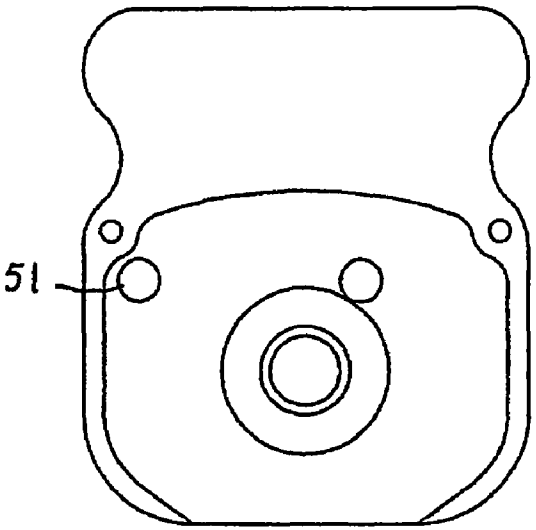
FIG. 6B is a rear elevation view of the housing of the rotary cutter of FIG. 6A.
Figure 6D:
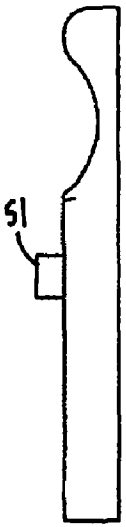
FIG. 6D is a side elevation view of the housing of FIG. 6A.
Figure 6F:
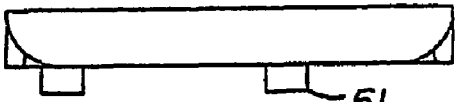
FIG. 6F is a top plan view of the housing of FIG. 6A.
Figure 6A:
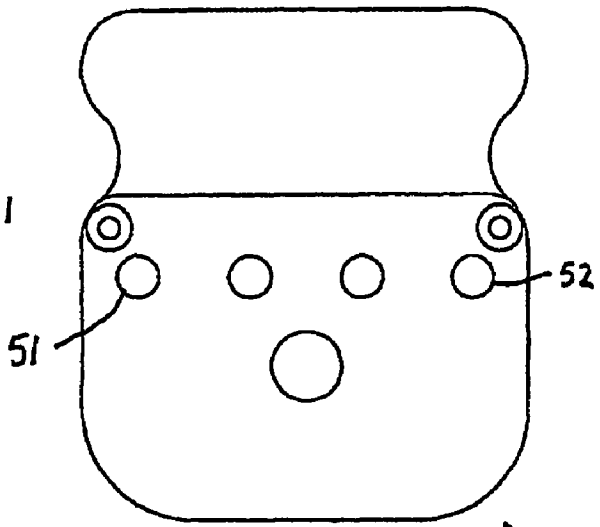
FIG. 6A is a front elevation view of the housing of a rotary cutter of the invention.
Figure 6E:
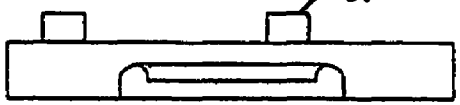
FIG. 6E is a bottom plan view of the housing of FIG. 6A.
Figure 6C:
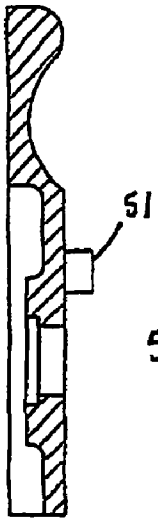
FIG. 6C is a cross-sectional view of the housing of FIG. 6A.
Figures 7A, 7B, 7C, 7D, 7E:
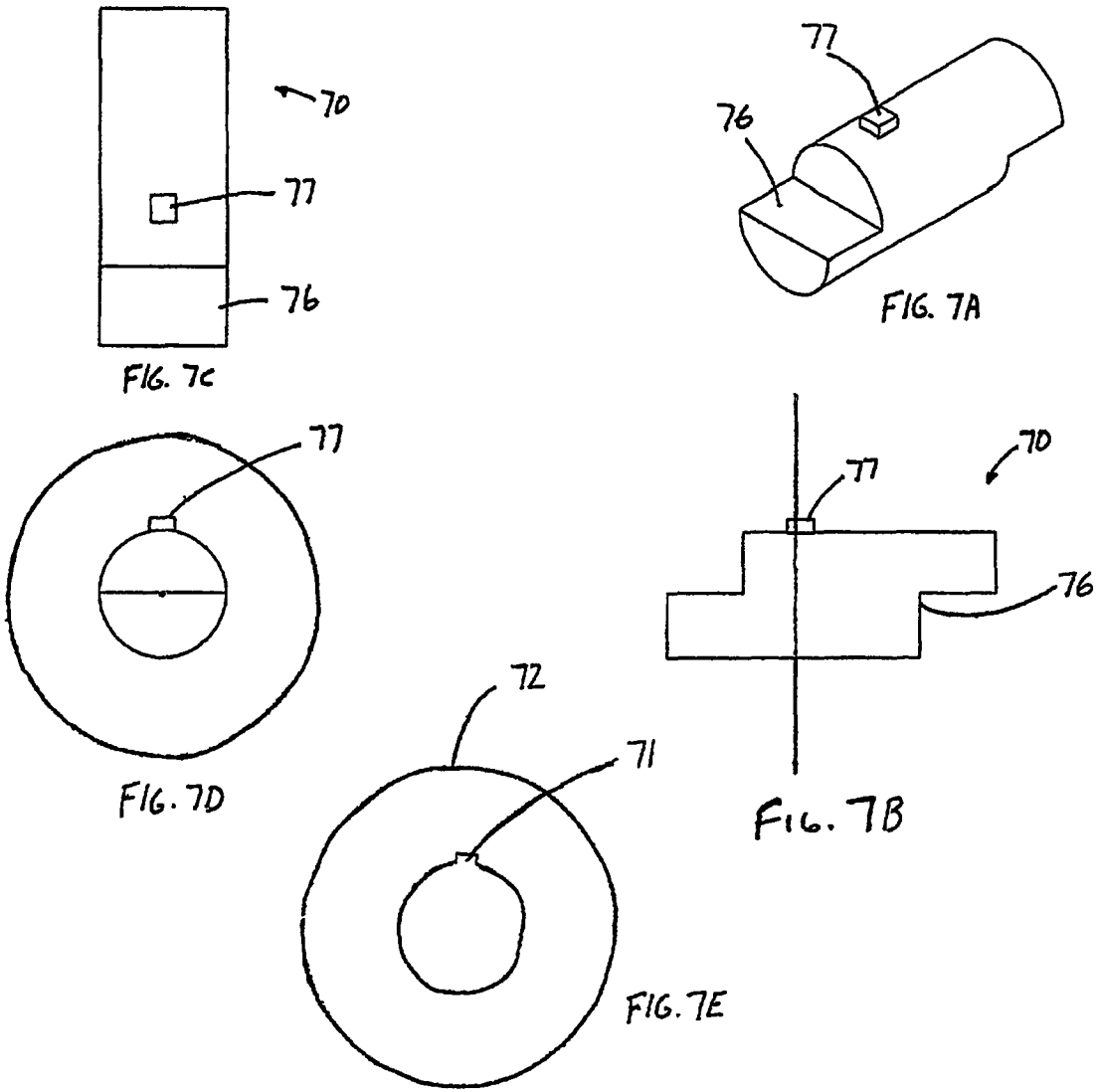
FIG. 7A is a perspective view of a rotary cutter shaft of the present invention.
FIG. 7B is a side elevation view of the rotary cutter shaft of FIG. 7A.
FIG. 7C is a top plan view of the rotary cutter shaft of FIG. 7A.
FIG. 7D is an elevation view of the end of the shaft engaged with a blade.
FIG. 7E is a front elevation view of a blade for a rotary cutter of the present invention having a notch.

A groove 90 extends along the length of the tool on its anterior side for accepting at least one of various attachments that move along its length, parallel to it. For example, the groove may accept, among other attachments, a guide 31 attached to a rotary cutter 33 as shown in FIG. 3. The guide with the rotary cutter, once attached to the main body using the groove, may then move parallel to the groove along the length of the tool, with the tool acting as a stabilizer and guide.

Referring now to FIGS. 3, 5A-5F and 6A-6F, the rotary cutter comprises one or more housings 50 described here as two housings that are a left and right housing. Each of the housings 50 comprises a cavity for receiving a circular blade 72 having a particular pattern and that rolls freely. The blade 72 is constrained within the housing 50 by a shaft 70 that preferably extends beyond the housing on either side. The blade extends a distance beyond the housing bottom to permit the blade to engage the paper or other material during use, wherein the pattern on the blade will form a line having a particular shape or design. In a preferred embodiment, each of the blades is located offset from the center of the housing so that the housings may be attached together to form patterned strips having three different widths (i.e., a narrow width, a medium width and a wide width). The shaft 70 and blade 72 preferably rotate in tandem. For example, the shaft 70 may have a key 77 protruding from a side that corresponds with a notch 71 on the blade 72. When the key engages the notch on the blade, the shaft and key turn as the blade turns.

If the user desires to cut a strip using two blades, it is appreciated that two housings may be connected together. On the outside of the housings are one or more pegs 51 and one or more holes 52. The pegs protrude out from the housing the same distance as is needed to fill the holes on the corresponding piece. It is preferred that the pegs are sized to fit snuggly within the respective holes so that when two housings are applied to each other, the pegs fill the holes and the holes accept the pegs securely.

In order to create a uniform strip, the shaft also preferably has a notch 76 on both its ends. The notch 76 will accept the notch from a second shaft when two housings are placed together so that the patterns of the blades 72 are aligned. Having the blades keyed to the shaft allows the two blades to turn at the same rate of speed which creates two identical cuts with patterns that mirror each other. It is appreciated that where the pattern on the blade repeats itself, the notches may be formed to allow them to align in more than one position (e.g., a plus sign may be used where the pattern repeats itself every ¼ turn) to facilitate the mating and alignment process.

The rotary cutter guide 31 shown in FIGS. 3 & 17A-17D consists of a ridge or tongue 35 that is sized to slide in the groove 90 of the main body 80, with one or more pegs 37 and one or more holes 39 on its side that correspond with the holes 52 and pegs 51 on the housing 50. This allows one or more housings to be operatively attached to the guide and travel an equal distance parallel to the main tool body, thereby creating a controlled cut.

The rotary cutter guide also has a circular indentation 36 that extends into it the depth necessary to accommodate the portion of the shaft 70 that protrudes outside of the housing 50.

The clip assemblies 20 shown in FIGS. 2 & 11A-11M are a set of two clips that connect to each end of the main body tool 80. Each connector 23 comprises a first hole 28 for receiving a flexible shaft 25 that allows the clip freedom to be pulled at an angle away from the plane perpendicular to the tool, and a second hole 30 for receiving a post 34 for engaging the connector of the tool body. The post 34 preferably includes a groove 22 near the top that holds an o-ring in place. In operation, when the post 34 is inserted into the hole or connector 11 of the tool body 80, it is held there firmly by the friction the o-ring provides.

In order to assist in removing the clips and avoiding damage to the paper, it is appreciated that the edge of the clips may be slit and chamfered to allow the clip to come off at an angle. At the end of the shaft is the clip head 27 that has a circular opening 29 sized to accept and firmly hold the flexible shaft 25. The clip head 27 also has a narrow opening 24 to accommodate the raised edge of many scrapbook pages. The clip heads are designed to be paired with one connector having a female end and one connector having a post to connect, respectively, to the male and female ends of the main tool body; although it is appreciated that they may be used with any combination of male and female ends and not depart from the scope of the present invention.

Another attachment that uses the main body as a guide is a straight cropper/strip cutter shown in FIG. 10A-10F. The straight cutter, generally designated by the numeral 100, includes a base portion 106 and a handle portion 103 extending upwardly from the base portion 106. The bottom of the base portion 106 includes a series of openings 101 that can accept into them a blade assembly 102. On the underside of the handle 103 is a ridge or tongue 104 that is sized to slide in the groove 90 of the main body 80, allowing the cutter 100 to move parallel to the tool body 80 to create a straight cut.

A blade 107 preferably extends outwardly from the bottom of the blade assembly 102 near one end to facilitate the cutting process. Each of the blade assemblies is preferably removable and can be moved from one opening to another. Furthermore, the blade assembly 102 can be turned upside-down to conceal the blade 107 in a corresponding blade cavity 105 on the top of the opening 101 for reasons such as safety concerns or storage. The blade assemblies 102 may also be rotated 180 degrees to permit the strip cutter 100 to be used in two directions (e.g., by both left- and right-handed people).

The removable blade assembly design allows the user to choose between one blade for a single cut, or two blades for strip cutting. Since the blades can be moved to different positions, the user can choose between a narrow strip or a wide strip, by positioning the blades close together or farther apart. While a strip having three opening is shown and disclosed, it is appreciated that the strip cutter may have any number of openings (e.g., four or more to allow a plurality of different sized strips to be cut). The openings or slots may also be unevenly spaced apart to create a larger selection of possible widths.

Referring now to FIGS. 9A-9D, a line guide that may use the main body 80 as a guide is shown. The line guide, generally designated by the numeral 95, comprises a generally flat base portion 93 and a connector member 94 extending upwardly therefrom. The base portion 93 comprises a series of holes 91 placed at various distances from the connector member for accepting a variety of different writing instruments. A ridge or tongue 92 on the connector member 94 is sized and shaped to travel in the groove 90 on the main body 80 so that parallel lines can easily be applied to a medium by sliding the guide right or left then moving the writing instrument to the next hole distal to it, then returning the guide to its original position, then repeating the process if desired. The line guide preferably includes one or more series of holes that are equally spaced apart. This creates a series of lines that are parallel to each other and spaced an equal distance from each other.

The body of the tool can also be used perpendicularly and can accept into its open end one of a plurality of interchangeable tools.

Figure 13A:
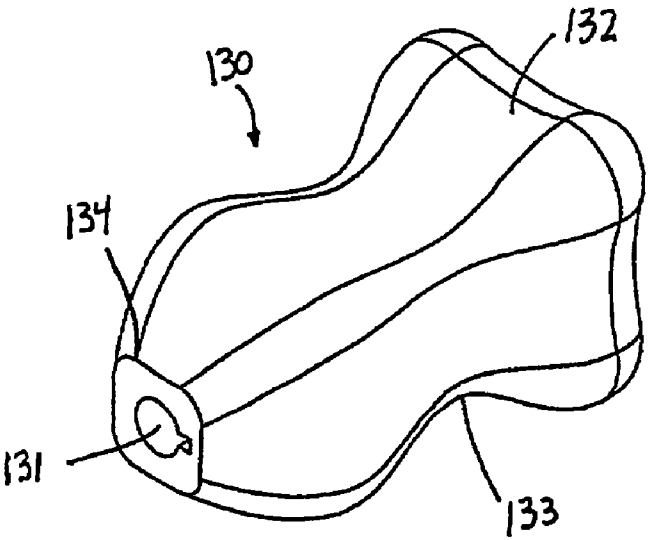
FIG. 13A is a perspective view of an ergonomic handle of the present invention.
Figure 13B:
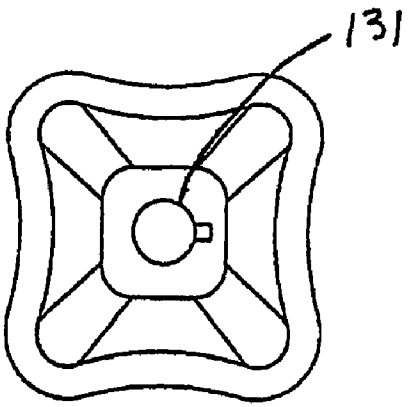
FIG. 13B is a top plan view of the ergonomic handle of FIG. 13A.
Figure 14A:
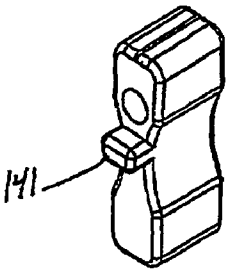
FIG. 14A is a perspective view of a blade assembly for the circle cutter of the present invention.
Figure 14B:
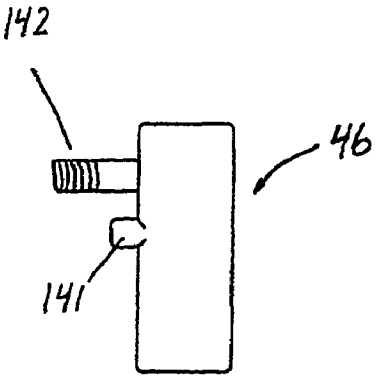
FIG. 14B is a side elevation view of the blade assembly of FIG. 14A.
Figure 14D:
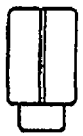
FIG. 14D is a top plan view of the blade assembly of FIG. 14A.
Figure 14C:
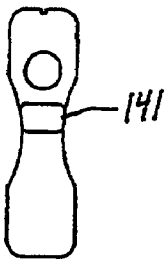
FIG. 14C is a front elevation view of the blade assembly of FIG. 14A.
Figure 14E:
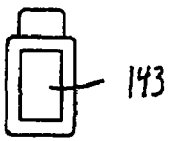
FIG. 14E is a bottom plan view of the blade assembly of FIG. 14A.
Figure 14F:
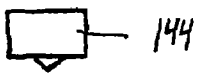
FIG. 14F is a side elevation view of a blade for use with the blade assembly of FIG. 14A.
Figure 15A:
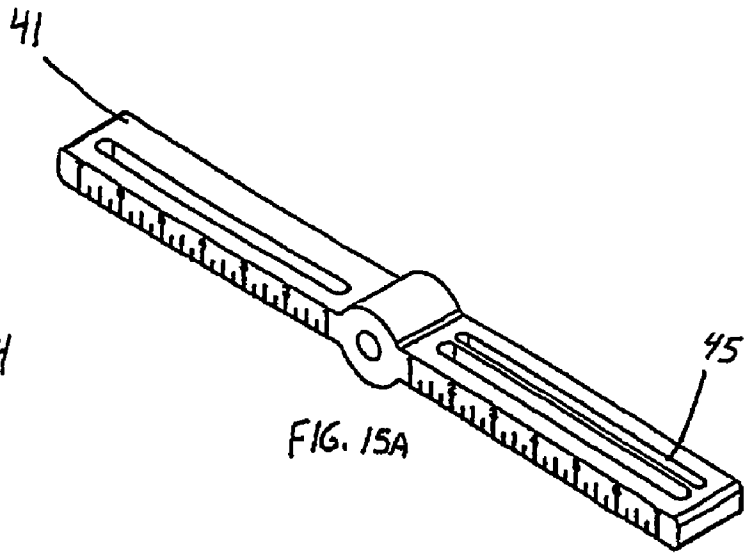
FIG. 15A is a perspective view of a circle cutter arm of the invention.
Figure 15D:
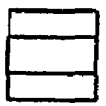
FIG. 15D is a side elevation view of the circle cutter arm of the present invention.
Figure 15B:
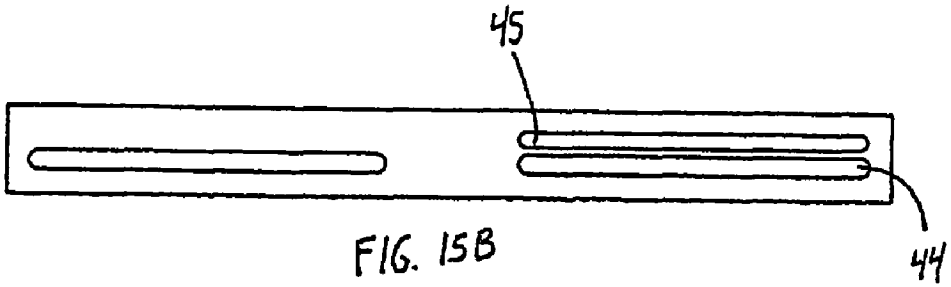
FIG. 15B is a side elevation view of the circle cutter arm of FIG. 15A.
Figure 15C:
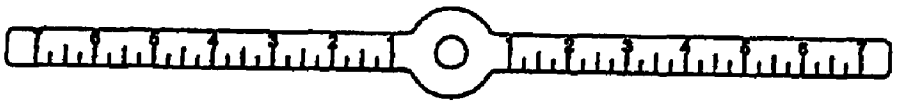
FIG. 15C is a top plan view of the circle cutter arm of FIG. 15A.
Figure 16A:
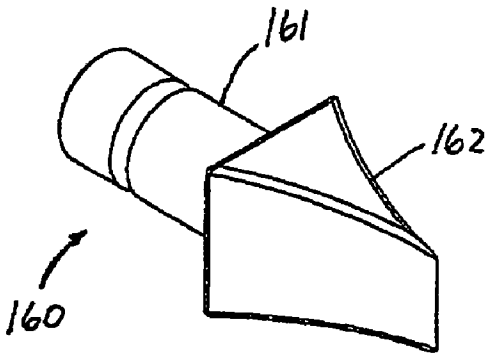
FIG. 16A is a perspective view of a sticker placer of the invention.
Figure 16E:
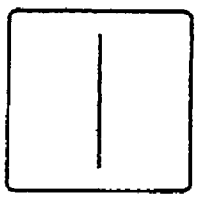
FIG. 16E is a front elevation view of the sticker placer of FIG. 16A.
Figure 16B:
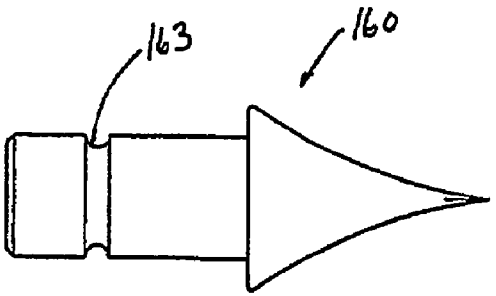
FIG. 16B is a side elevation view of the sticker placer of FIG. 16A.
Figure 16C:
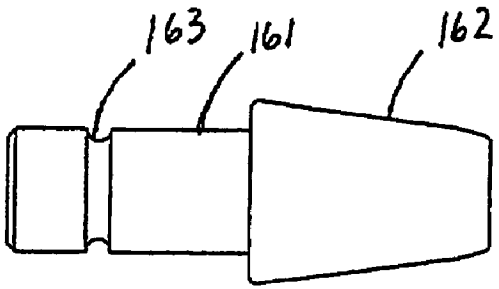
FIG. 16C is a top plan view of the sticker placer of FIG. 16A.
Figure 16D:
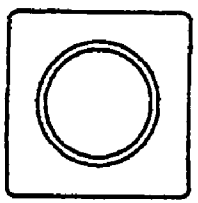
FIG. 16D is a rear elevation view of the sticker placer of FIG. 16A.
Figure 17A:
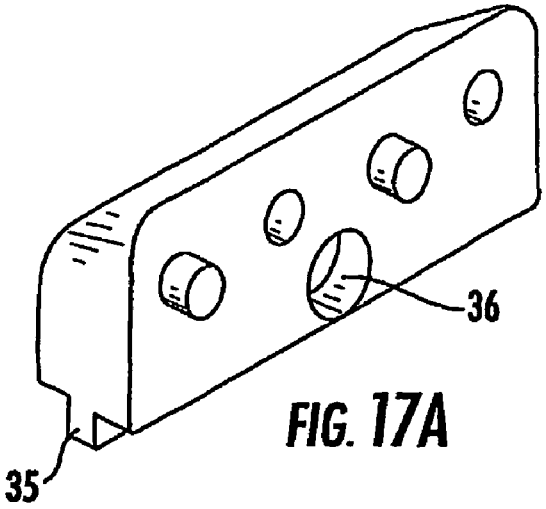
FIG. 17A is a perspective view of a guide attachment for the rotary cutter of the present invention.
Figure 17B:
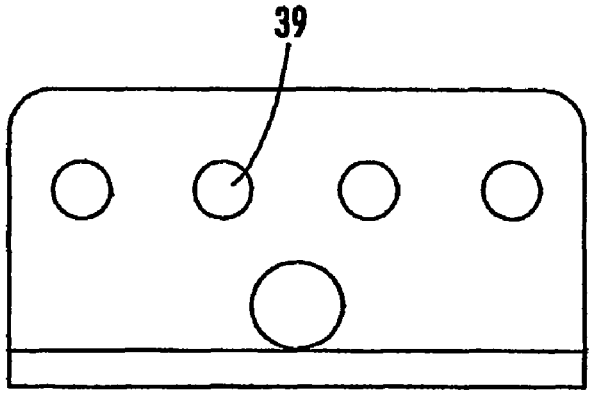
FIG. 17B is a front elevation view of the guide attachment of FIG. 17A.
Figure 17C:
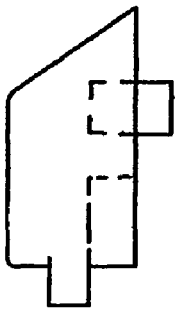
FIG. 17C is a side elevation view of the guide attachment of FIG. 17A.
Figure 17D:
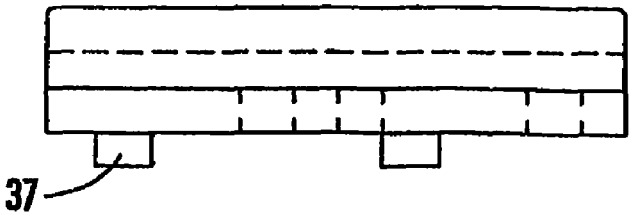
FIG. 17D is a top plan view of the guide attachment of FIG. 17A.

Referring now to FIGS. 13A and 13B, an ergonomic handle for use with one or more tools is shown. This handle, generally designated by the numeral 130, has a generally bulbous upper portion 132 for being received within the palm of a user, a middle portion 133 generally tapering from the upper portion for receiving fingers of the user, and a lower portion having notched tubular opening 131 that extends into the body a length necessary to accommodate a connector of a tool.

Figure 19C:
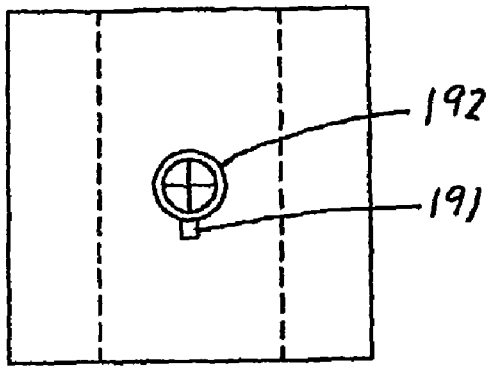
FIG. 19C is a top plan view of the stamp mount of FIG. 19A.
Figure 19A:
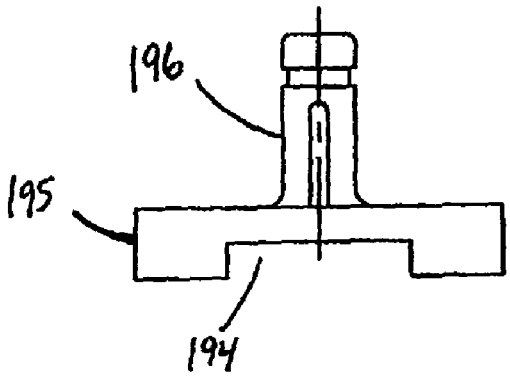
FIG. 19A is a side elevation view of a stamp mount of the present invention.
Figure 19B:
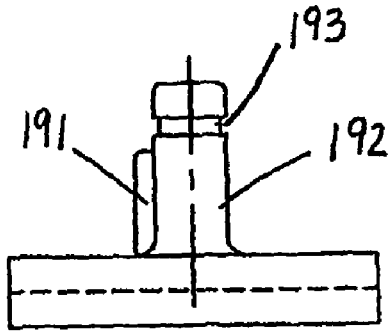
FIG. 19B is a front elevation view of the stamp mount of FIG. 19A.
Figure 20B:
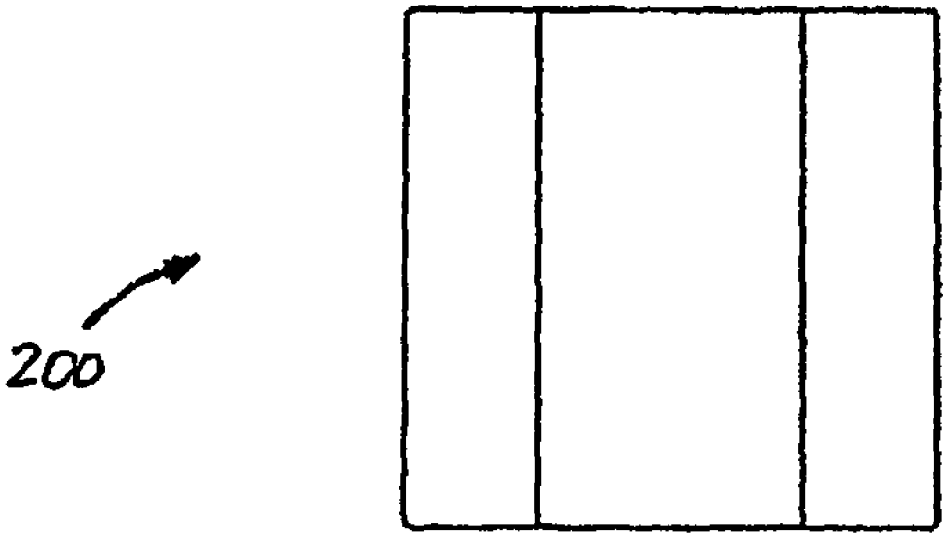
FIG. 20B is a front elevation view of the stamp backing of the present invention.
Figure 20A:
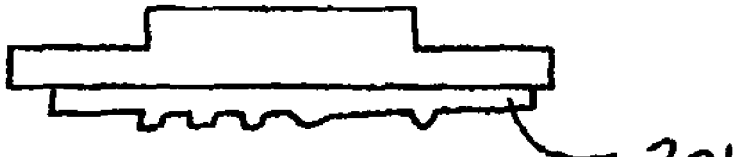
FIG. 20A is a front elevation view of a stamp backing of the present invention.

Referring now to FIGS. 19A to 19C, a stamp mount is shown. The stamp mount, generally designated by the numeral 190, includes a base 195 and a post 192 extending from about the center of the base 195. The post 192 includes a spline 191 that fits within the notch on the handle opening and prevents the stamp mount from turning within the handle, and a groove 193 near the top that holds an o-ring in place. In operation, when the post 192 is inserted into the end 134 of the handle, it is held there firmly by the friction the o-ring provides. On the bottom side of the stamp mount is an opening 194 that will accept into it a stamp backing 200 having a rubber image 201 affixed to the bottom side (as shown in FIGS. 20A and 20B).

Referring now to FIGS. 4, 12A-12J, 14A-14F & 15A-15D, a circle cutter of the present invention is shown. The circle cutter, generally designated by the numeral 40, comprises a free arm 41 that rotates around a fixed post 42. The distal end of this post has a circle cutter base 47 having an opening for receiving a rubber disc 43 used to secure the material and prevent it from slipping. Along the side of the arm 41 is a slot 44 that allows the blade assembly 46 to slide proximally and distally in relation to the post 42. Under this slot 44 is a groove 45 for receiving a peg 141 that protrudes out of the blade assembly 46 to provide stability and prevent the blade assembly 46 from twisting when the arm 41 is rotated and pressure is applied to it.

In operation, a user rotates the arm 41 around the post 42 so that the blade, in contact with the desired material and maintained at an equal distance from its axis, creates a cut in a circular pattern. If desired, a second blade assembly can be attached to the arm at a distance from the axis not equal to the position of the original blade assembly so that when the user rotates the arm, two cuts are created simultaneously, resulting in a donut shaped cut. A threaded stud 142 protrudes from the blade assembly the length needed to pass through the slot in the circle cutter arm and apply a nut to the end of the stud. A cavity 143 on the underside of the blade assembly housing holds a blade 144 securely within it.

Figure 18:
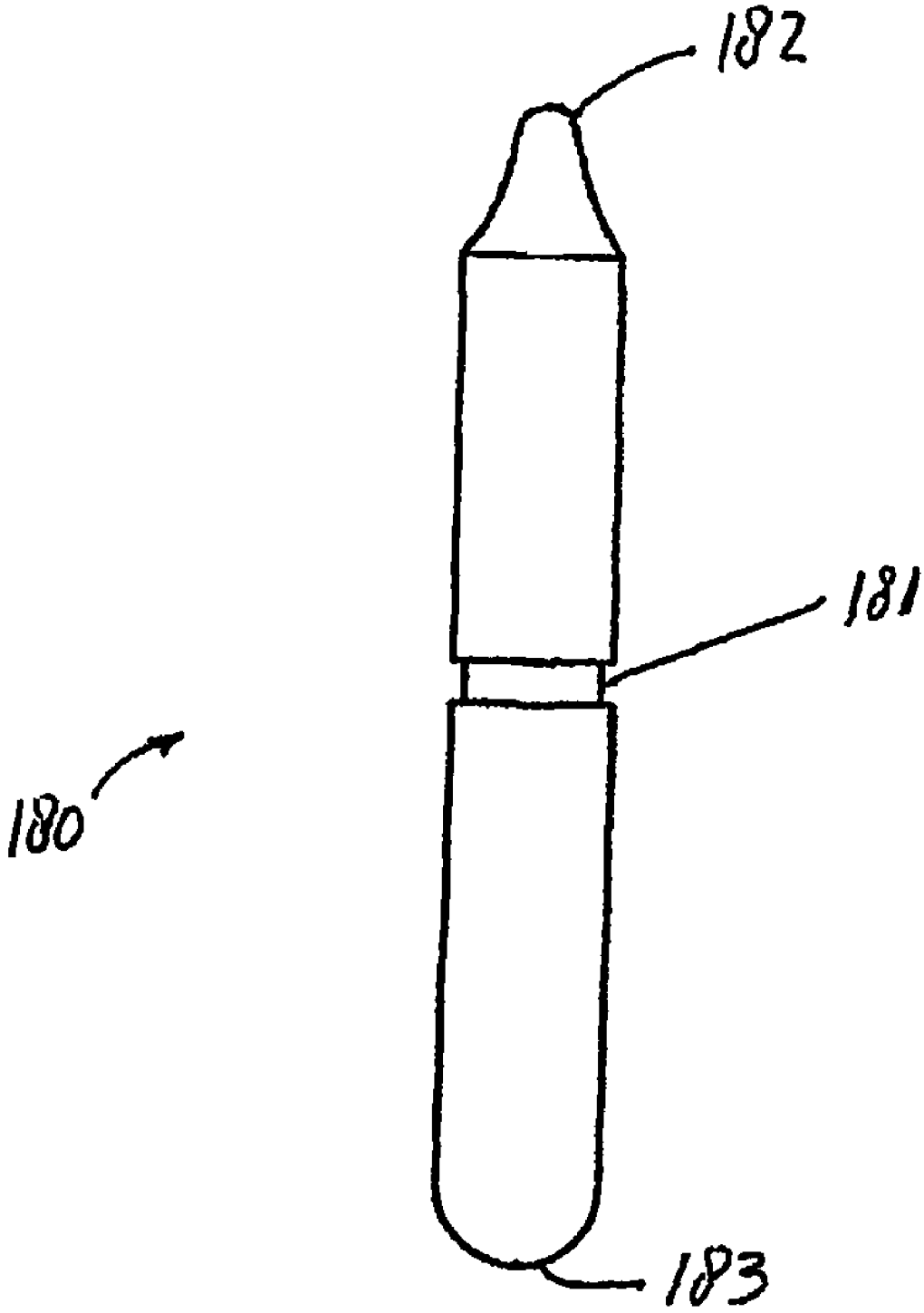
FIG. 18 is a top plan view of an embossing tip of the present invention.

The embossing tip, generally designated by the numeral 180 as shown in FIG. 18, may also be used in conjunction with the ergonomic handle 130. The embossing tip consists 180 of a double tipped shaft with a groove 181 for an o-ring at its midsection. One end 182 of the embossing tip is smaller than the other end 183 to better function in small spaces on detailed stencils. The embossing tool is used to apply pressure to the back side of various types of material and along the perimeters of a stencil, to create a raised impression on the front side of the material. This is accomplished by placing a stencil on a hard surface, then placing the desired material face down on the stencil. Then by using either an identical stencil, or a light source underneath the stencil, such as a lightbox, the embosser tip is used to apply pressure to the paper around the perimeters of the stencil and a raised impression results on the front side of the paper. The embosser tip may be made out of a glass-filled nylon or other known materials that are hard and smooth.

Referring now to FIGS. 16A through 16E, a sticker placer/remover attachment is shown. The sticker placer/remover, generally designated by the numeral 160, comprises a post 161 that may be inserted into the hole 131 in the end 134 of the ergonomic handle 130 and a wedge shaped end 162. The sticker place/remover attachment preferably has sharp corners to facilitate the removal of the sticker from the sticker page. Furthermore, the handle design, which allows the handle to be held out of the sight line to the attachment during use, makes placement on the page more accurate due to the fact that the position of the sticker can be seen at all times without ones fingers being in the way. Accordingly, the handle may be used when handling very small stickers such as the dot of an "i" and other small objects.

This same tip is also designed to remove stickers that have inadvertently been placed in the wrong position. The tip of this attachment is placed underneath the edge of the sticker and forward pressure applied in order to lift the sticker off of the page without removing any of the underlying paper to which it was adhered.

Figure 21:
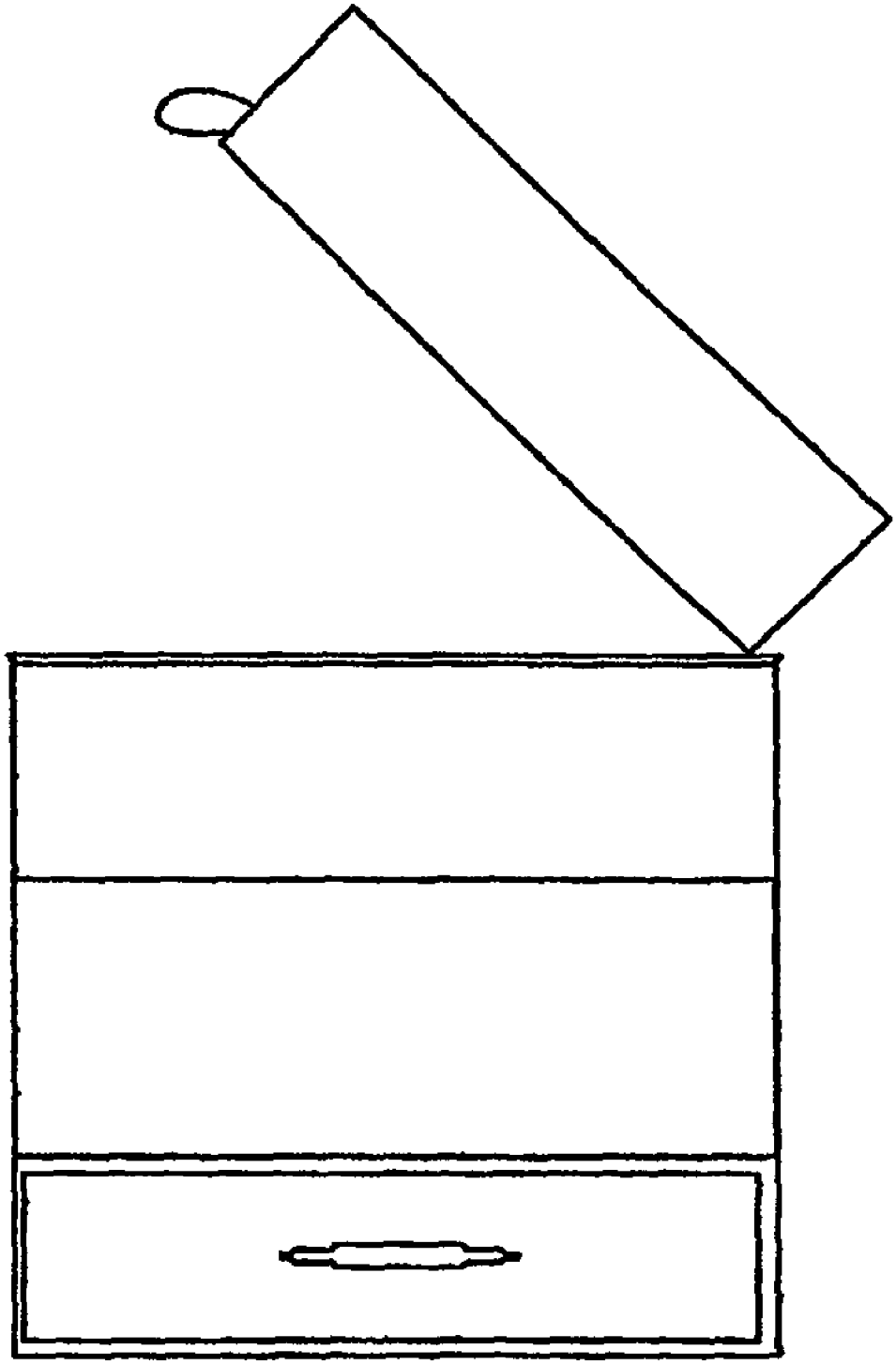
FIG. 21 is a side elevation view of a storage box of the present invention.
Figure 22:
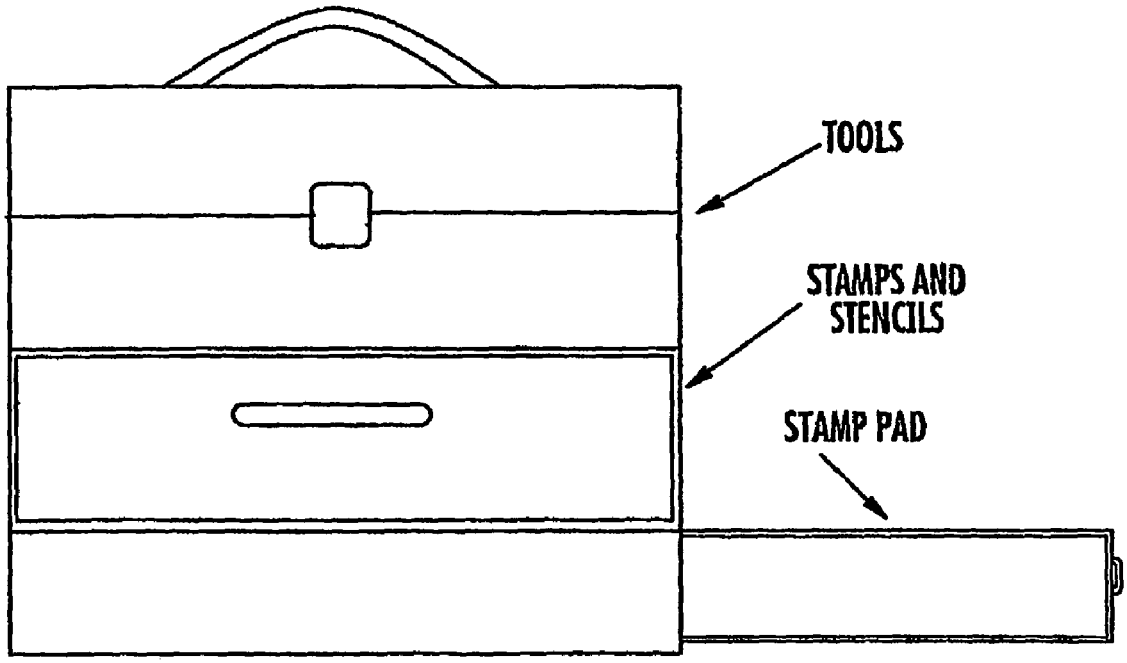
FIG. 22 is a front elevation view of the storage box of FIG. 21.

FIGS. 20 and 21 illustrate a box that may be utilized to store the tool body, tools, stamps and/or other accessories. In a preferred embodiment, the box includes various drawers and compartments that open in such a way that everything is accessible at the same time.

It is also appreciated that the box may include an area for housing a multi-colored stamp pad with a disposable cleaner pad so that the user can stamp an image in one color. In such a case, it is appreciated that the drawer or other enclosure housing the stamp pad be sealed around its edges so that, when in the closed position, it prevents the stamp pads from drying out. In operation, after removing the excess ink on the cleaner pad, a user can subsequently stamp an image in a different color without having the inconvenience of many individual ink pads.

Many modifications and variations of the present invention are possible in light of the above teachings. It is therefore to be understood that within the scope of the appended claims, the invention may be practiced otherwise than as specifically described.

What is claimed is:

1. A rotary cutting unit for making two simultaneous spaced-apart cuts comprising:

a first cutting member comprising:

a housing having a center, a first side and a second side;

a shaft extending through the housing;

a circular cutting blade held in place by the shaft such that a portion of the circular cutting blade extends beyond the housing; and a connector; and a second cutting member comprising:

a housing having a center, a first side and a second side;

a shaft extending through the housing;

a circular cutting blade held in place by the shaft such that a portion of the circular cutting blade extends beyond the housing; and a connector, wherein the connector of the first cutting member and the connector of the second cutting member are adaptable to selectively attach the first and second cutting members together, wherein the connectors of the first and second cutting members comprises a plurality of pegs and corresponding holes on the sides of the first and second cutting members.

2. The rotary cutting unit of claim 1 in combination with an elongated tool having a groove extending along the length of the tool, and means for slidingly attaching either side of the housing to the groove.

3. The rotary cutting unit of claim 2 wherein the means for slidingly attaching either side comprises an adapter having a tongue for engaging the groove and wherein the side of the housing and the adapter comprise corresponding pegs and holes for snappingly connecting the housing and adapter together.

4. The rotary cutting unit of claim 2 wherein the shaft of the first housing further comprises a key and the cutting blade of the first housing comprises a notch for receiving the key, and wherein the shaft of the second housing comprises a key and the cutting blade of the second housing comprises a notch for receiving the key.

5. The rotary cutting unit of claim 1 wherein the circular cutting blades are located offset from the center of the housings, whereby the housings may be attached together to form patterned strips having three different widths.

6. The rotary cutting unit of claim 1 which further comprises means for aligning the circular cutting blades.

7. The rotary cutting unit of claim 6 wherein the means for aligning the blades comprises a first notch on an end of the shaft of the first cutting member and a corresponding second notch on the end of the shaft of the second cutting member.

8. The rotary cutting unit of claim 5 which further comprises a first notch on an end of the shaft of the first cutting member and a corresponding second notch on the end of the shaft of the second cutting member to permit the circular cutting blades to be aligned.

9. The rotary cutting unit of claim 1 which further comprises an elongated tool having a groove extending along the length of the tool and means for selectively attaching the first or second housing to slidingly move within the groove.

10. The rotary cutting unit of claim 1 which further comprises an elongated tool having a groove extending along the length of the tool and an adapter attachable to the first or second cutting member and comprising a tongue for slidingly moving within the groove.

11. A rotary cutting unit for making two simultaneous spaced-apart cuts comprising:

a first cutting member comprising:

a housing having a center, a first side and a second side;

a shaft extending through the housing;

a circular cutting blade held in place by the shaft such that a portion of the circular cutting blade extends beyond the housing; and a connector;

a second cutting member comprising:

a housing having a center, a first side and a second side;

a shaft extending through the housing;

a circular cutting blade held in place by the shaft such that a portion of the circular cutting blade extends beyond the housing;

a connector, wherein the connector of the first cutting member and the connector of the second cutting member are adaptable to selectively attach the first and second cutting members together; and means for aligning the circular cutting blades, wherein the means for aligning comprises a first notch on an end of the shaft of the first cutting member and a corresponding second notch on the end of the shaft of the second cutting member.

12. The rotary cutting unit of claim 11 wherein the connectors of the first and second cutting members comprises a plurality of pegs and corresponding holes on the sides of the first and second cutting members.

13. The rotary cutting unit of claim 11 which further comprises means for aligning the circular cutting blades.

14. A rotary cutting unit for making two simultaneous spaced-apart cuts in combination with an elongated tool, the combination comprising:

a first cutting member comprising:

a housing having a center, a first side and a second side;

a shaft extending through the housing;

a circular cutting blade held in place by the shaft such that a portion of the circular cutting blade extends beyond the housing; and a connector;

a second cutting member comprising:

a housing having a center, a first side and a second side;

a shaft extending through the housing;

a circular cutting blade held in place by the shaft such that a portion of the circular cutting blade extends beyond the housing;

a connector, wherein the connector of the first cutting member and the connector of the second cutting member are adaptable to selectively attach the first and second cutting members together; and an elongated tool having a groove extending along the length of the tool and means for selectively attaching the first or second housing to slidingly move within the groove.

15. The rotary cutting unit and elongated tool of claim 14 wherein the means for selectively attaching includes an adapter attachable to the first or second cutting member and comprising a tongue for slidingly moving within the groove.

* * * * *

UNITED STATES PATENT AND TRADEMARK OFFICE

CERTIFICATE OF CORRECTION

PATENT NO. : 7,849,775 B2
APPLICATION NO. : 11/909362
DATED : December 14, 2010
INVENTOR(S) : Regina Yoder It is certified that error appears in the above-identified patent and that said Letters Patent is hereby corrected as shown below:

On the Title page, in item (73), the assignee "Craft-N-Doodle, LLC, Lexington, KY (US)" should be omitted. There is no assignee. Please omit the assignee block (73).

Signed and Sealed this
Fourteenth Day of June, 2011

David J. Kappos

David J. Kappos
*Director of the United States Patent and Trademark Office*